US007267248B2

(12) United States Patent
Yerby et al.

(10) Patent No.: US 7,267,248 B2
(45) Date of Patent: Sep. 11, 2007

(54) AEROSOL DISPENSER FOR MIXING AND DISPENSING MULTIPLE FLUID PRODUCTS

(75) Inventors: Patrick Timothy Yerby, Woodstock, IL (US); Mark Neuhalfen, Mt. Prospect, IL (US)

(73) Assignee: Seaquist Perfect Dispensing Foreign, Cary, IL (US)

( * ) Notice: Subject to any disclaimer, the term of this patent is extended or adjusted under 35 U.S.C. 154(b) by 0 days.

(21) Appl. No.: 10/441,568

(22) Filed: May 20, 2003

(65) Prior Publication Data

US 2004/0004088 A1 Jan. 8, 2004

Related U.S. Application Data

(60) Provisional application No. 60/382,283, filed on May 21, 2002.

(51) Int. Cl.
*B65D 35/22* (2006.01)
*B65D 35/28* (2006.01)
*B65D 83/28* (2006.01)

(52) U.S. Cl. ..... 222/94; 222/95; 222/136; 222/145.5; 222/402.18; 222/402.23; 222/402.25

(58) Field of Classification Search ..... 222/94, 222/95, 136, 145.5, 402.18, 402.21, 402.22, 222/402.23, 402.25, 402.24
See application file for complete search history.

(56) References Cited

U.S. PATENT DOCUMENTS 3,241,722 A 3/1966 Nissen
3,454,198 A 7/1969 Flynn
3,474,934 A * 10/1969 Forim ..... 222/136
3,506,241 A 4/1970 Ewald
3,545,720 A 12/1970 Ewald
3,547,405 A 12/1970 Ewald
3,550,813 A * 12/1970 Lehmann ..... 222/94
3,658,294 A 4/1972 Ewald
3,731,847 A 5/1973 Webster
3,894,659 A * 7/1975 Focht ..... 222/94
5,167,347 A 12/1992 Wiegner et al.
6,651,847 B2 11/2003 Mekata et al.
6,736,288 B1 * 5/2004 Green ..... 222/94
2002/0185501 A1 * 12/2002 Yquel ..... 222/94
2003/0089739 A1 5/2003 O'Connor et al.

* cited by examiner

*Primary Examiner*—Joseph A. Kaufman
(74) *Attorney, Agent, or Firm*—Frijouf, Rust & Pyle, P.A.

(57) ABSTRACT

An improved aerosol dispenser is disclosed for mixing and dispensing a first and second fluid. The improved aerosol dispenser comprises a valve body sealably mounted to the aerosol container. A first and a second channel is defined in the valve body for providing fluid communication with a valve body cavity of the valve body. A first and a second inner container are located within the aerosol container for communicating with the first and second channels, respectively. A valve assembly comprising a first and a second valve element enables the mixing and dispensing of the first and second fluids from a terminal orifice upon the simultaneous actuation of the first and second valve elements. The invention is also incorporated into the process of filling an improved aerosol dispenser with a first and a second fluid products and an aerosol propellant.

8 Claims, 9 Drawing Sheets

AEROSOL DISPENSER FOR MIXING AND DISPENSING MULTIPLE FLUID PRODUCTS

CROSS-REFERENCE TO RELATED APPLICATIONS

This application claims benefit of U.S. Patent Provisional application Ser. No. 60/382,283 filed May 21, 2002. All subject matter set forth in provisional application Ser. No. 60/382,283 is hereby incorporated by reference into the present application as if fully set forth herein.

BACKGROUND OF THE INVENTION

1. Field of the Invention

This invention relates to aerosol dispensing from a terminal orifice and more particularly to an improved aerosol dispenser for simultaneously mixing and dispensing multiple fluids from an aerosol container.

2. Background of the Related Art

Over the last half of this century, aerosol valve dispensers have demonstrated to be versatile and efficient systems for dispensing a fluid product. A large variety of different types of fluid products have been used with aerosol valve dispensers over the years. In general, aerosol valve dispensers comprise a container containing a product and a pressurized propellant sealed with the aerosol valve. The actuation of the aerosol valve enables the product and propellant to be discharged through the aerosol valve for the intended use of the fluid product. A large variety of aerosol buttons, overcaps, nozzles, and the like were typically incorporated for providing the proper flow pattern and other physical characteristics of the product discharge from the aerosol valve.

One very desirable type of aerosol dispenser is an aerosol dispenser capable of simultaneously dispensing multiple fluids from an aerosol container. Typically, the aerosol container is partitioned for separating the multiple fluids. The multiple fluids flow through an aerosol valve for discharge from a terminal orifice. The multiple fluids are mixed within the aerosol valve or an aerosol valve stem prior to discharge of the mixture from the terminal orifice.

The mixing of all the multiple fluids prior to discharge from the terminal orifice enables the multiple fluids to react with one another thereby providing a unique aerosol product. For example, the multiple fluids may react to provide a heated aerosol product discharged from the terminal orifice. Examples of desirable heated aerosol products include shaving gels, shaving foams and the like. In addition, the multiple fluids may react to dispense a two part hair color for the home hair color market.

One difficulty encountered in dispensing multiple fluids from an aerosol dispenser is the restriction in the operational orientation of the aerosol dispenser. Typically, an aerosol dispenser device capable of dispensing multiple fluids from an aerosol container is actively operated with the container being positioned in an inverted position. The following are examples of prior art devices that have attempted to dispense multiple fluids from an aerosol container.

U.S. Pat. No. 3,241,722 to Nissen discloses dispensing devices and more particularly an improved dispensing device and valve structure for controlling the coordinated mixing and dispensing of materials under pressure from two separate containers to provide a combined product.

U.S. Pat. No. 3,454,198 to Flynn discloses a pressurized dispensing device having two containers, each of which has an outlet orifice. A valve assembly for controlling the selective dispensing of a mixture of materials from the two containers includes a flexible tubular nozzle structure and a rigid core structure, the upper portion of which is disposed inside the nozzle structure. Formed on the upper portion of the core structure are two helically threaded sections of the same lead, the inlet section having a triple thread and the outlet section having a single thread. Formed on the lower portion of the core, which is disposed inside a valve housing, is an annular valve surface that closes the main outlet from the two containers. In addition, the lower portion of the core carries a valve element that closes the outlet orifice from one of the containers. Formed at the outlet end of the nozzle are four triangular projections that define a discharge orifice of cruciform configuration to provide four outlet passages surrounding the core.

U.S. Pat. No. 3,731,847 to Webster discloses a pressurized dispensing package having a self-supporting flexible walled inner container disposed within and seated on the base of a rigid walled outer container. A valve assembly controls the mixing of materials stored in the containers and the flow of that mixture to the atmosphere. Dip tubes secured to the valve assembly extend to the bottom of each container. The outer container is charged with propellant through the valve stem of the valve assembly. An actuator cap on the stem is pivoted about a tilt axis to open the valve and discharge a mixture.

U.S. Pat. No. 5,167,347 to Wiegner et al. discloses a multi-fluid mixing and automatic metering dispenser for co-dispensing a pressurized permanent hair dye composition, having a first container containing a hair dye and propellant material, a second container disposed within the first container and containing a dye developer material, a nozzle structure defining a discharge passageway and a valve structure having first and second valves for controlling passage of the materials through the nozzle. The nozzle structure permits concurrent operation of the first and second valves to permit simultaneous flow of the materials from the first and second containers through the discharge passageway under the influence of the propellant, such that the materials exit from the dispenser at an overall flow rate not greater than about 1.8 gm/sec, and the flow ratio of the hair dye and propellant material exiting the first valve to the dye developer material exiting the second valve is in the range of about 1.9 to 2.5:1.

Therefore it is an object of this invention to provide an aerosol dispenser for mixing and dispensing multiple fluid products that overcomes the problems of the prior art and provides a significant advancement to the aerosol dispensing industry.

Another object of this invention is to provide an aerosol dispenser for mixing and dispensing multiple fluid products capable of mixing and dispensing a large variety of different fluids from an aerosol container.

Another object of this invention is to provide an aerosol dispenser for mixing and dispensing multiple fluid products that is unrestricted in the operational orientation of the aerosol dispenser.

Another object of this invention is to provide an aerosol dispenser for mixing and dispensing multiple fluid products that is capable of operating in an upright or an inverted position.

Another object of this invention is to provide an aerosol dispenser for mixing and dispensing multiple fluid products that operates as a conventional aerosol dispenser.

Another object of this invention is to provide an aerosol dispenser for mixing and dispensing multiple fluid products that may be incorporated into an existing aerosol container without modification.

Another object of this invention is to provide a process of filling an improved aerosol dispenser with a first and a second fluid products and an aerosol propellant.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

A specific example of the best mode of practicing the present invention is shown in the attached drawings. For the purpose of summarizing the invention, the invention relates to an improved aerosol dispenser for mixing and dispensing a first and second fluid from an aerosol container through a terminal orifice. The improved aerosol dispenser comprises a valve body sealably mounted to the aerosol container with the valve body having a valve body cavity. A first channel is defined in the valve body for providing fluid communication with the valve body cavity. A second channel is defined in the valve body for providing fluid communication with the valve body cavity. A first inner container is located within the aerosol container and communicates only with the first channel. A second inner container is located within the aerosol container and communicates only with the second channel. A valve assembly comprising a first and a second valve element is disposed in the valve body cavity for inhibiting the flow of the first and second fluids from the terminal orifice. The valve assembly enables the mixing and dispensing of the first and second fluids from the terminal orifice upon the simultaneous actuation of the first and second valve elements.

In a more specific example of the invention, a mounting cup sealably mounts a first end of the valve body to the aerosol container. The first channel is defined in an end of the valve body and the second channel is defined in the valve body remote from the first channel.

Preferably, the first and second inner containers comprise first and second flexible inner containers. In one example of the invention, the first inner container is located within the second inner container. The first inner container is secured to a second end of the valve body for communicating only with the first channel. The second inner container is secured to the mounting cup for communicating only with the second channel.

In another specific example of the invention, the valve assembly comprises a bias spring interposed between the first and second valve elements for simultaneously biasing the first and second valve elements into sealing engagement with the first and second channels, respectively. The second valve element is movably mounted relative to the first valve element. The first and second valve elements enable the dispensing of the first and second fluids from the terminal orifice upon the tilting of the first and second valve elements.

The invention is also incorporated into the process of filling an improved aerosol dispenser with a first and a second fluid products and an aerosol propellant. The process comprises filling a second inner container located within an aerosol container with the second fluid product. A first inner container located within the second container is filled with the first fluid product. The aerosol container is filled with the aerosol propellant.

In a more specific example of the process, the second flexible inner container within an aerosol container through a mounting cup opening in the aerosol container adapted for receiving an aerosol valve and mounting cup assembly. The second flexible inner container is filled with the second fluid product through the mounting cup opening in the aerosol container. The first flexible inner container and an aerosol mount cup and valve assembly are inserted through the mounting cup opening in the aerosol container. The aerosol mount cup and valve assembly are sealed to the mounting cup opening in the aerosol container. The first container is filled with the first fluid product through the aerosol mount cup and valve assembly. The aerosol container is filled with the aerosol propellant through a filling aperture distinct from the mounting cup opening in the aerosol container.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
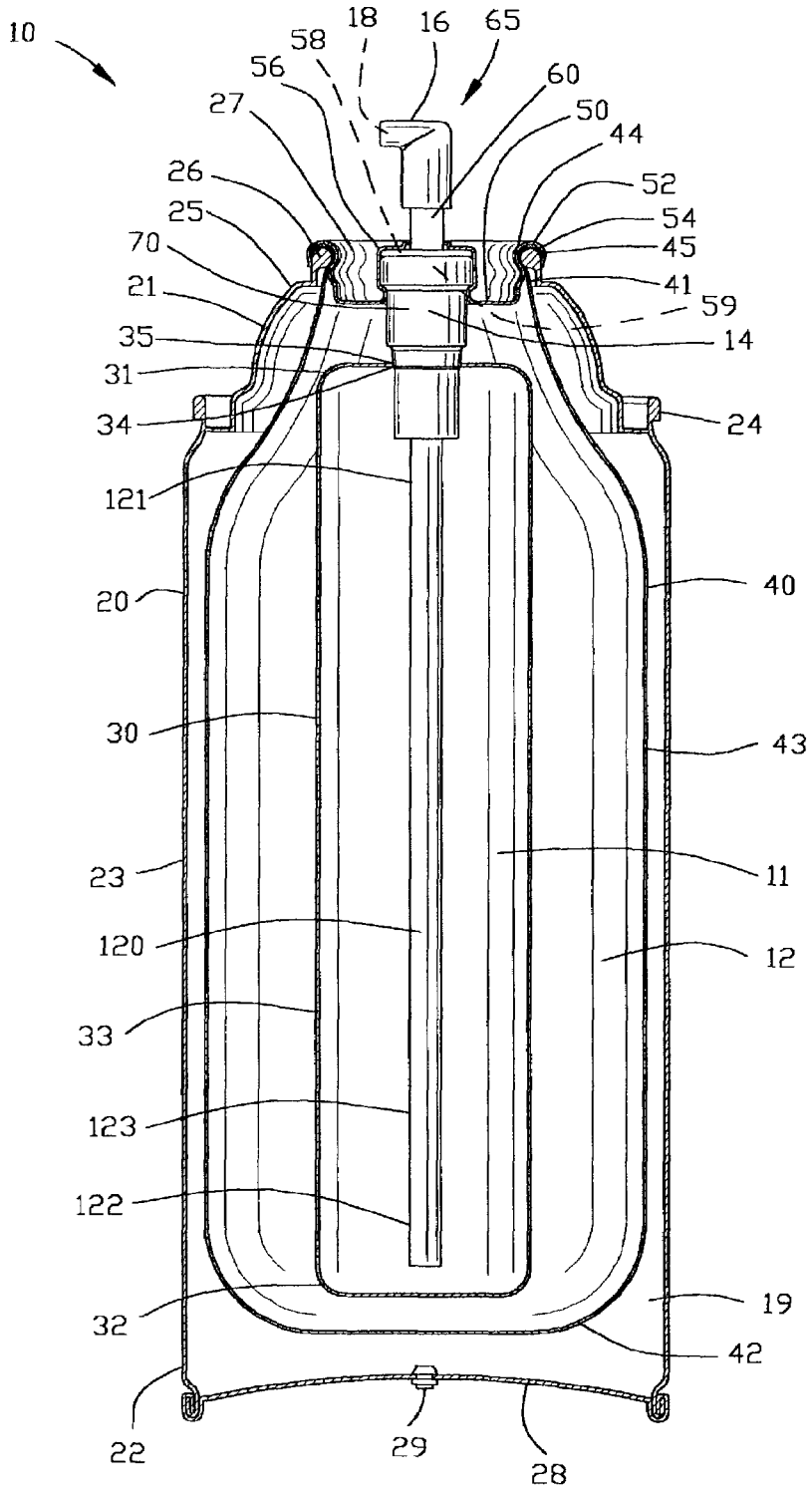
FIG. 1 is a side view partially in section of an improved aerosol dispenser for mixing and dispensing a first fluid product with a second fluid product from an aerosol container.

FIG. 1 is a side view partially in section of an improved aerosol dispenser 10 for mixing and dispensing a first fluid product 11 and a second fluid product 12. An aerosol valve 14 controls the flow of the first and second fluid products 11 and 12 through an actuator 16 for discharge from a terminal orifice 18. The first and second fluid products 11 and 12 as well as an aerosol propellant 19 are stored within an aerosol container 20. The aerosol propellant 19 may be compressed gas, carbon dioxide or any other suitable propellant.

The aerosol container 20 is shown as a cylindrical container of conventional design and material. The aerosol container 20 extends between a top portion 21 and a bottom portion 22. The aerosol container 20 defines a cylindrical sidewall 23 defining a container rim 24 extending about an outer diameter of the aerosol container 20. The top portion 21 of the aerosol container 20 tapers radially inwardly into a neck 25 terminating in a bead 26 that defines a mounting cup opening 27 in the aerosol container 20. The bottom portion 22 of the aerosol container 20 is closed by an endwall 28 having a filling aperture and plug 29. The filling aperture and plug 29 is distinct from the mounting cup opening 27 in the aerosol container 20.

The filling aperture and plug 29 enables the aerosol propellant 19 to be introduced into the aerosol container 20 and to be seal by the plug 29 after filling with the aerosol propellant 19. In the alternative, a filling aperture and plug 29 may be a one-way filling valve for filling the aerosol container 20 with the aerosol propellant 19. The one-way filling valve may be a one-way filling valve commonly referred to as an umbrella valve. Preferably, aerosol container 20 is filled by conventional filling machine well known in the art.

A first inner container 30 containing the first fluid product 11 is located within the aerosol container 20. The first inner container 30 extends between a top portion 31 and a bottom portion 32 and defines a sidewall 33 therebetween. The top portion 31 of the first inner container 30 defines a first inner container opening 34 whereas the bottom portion 32 of the first inner container 30 is closed to provide a fluid tight seal. The first inner container 30 is formed from a flexible material for enabling an external pressure from the aerosol propellant 19 to propel the first fluid product 11 from the first inner container 30. The first inner container 30 is secured to the aerosol valve 14 by a connector 35.

A second inner container 40 containing the second fluid product 12 is located within the aerosol container 20. The second inner container 40 extends between a top portion 41 and a bottom portion 42 and defines a sidewall 43 therebetween. The top portion 41 of the second inner container 40 defines a second inner container opening 44 whereas the bottom portion 42 of the first inner container 40 is closed to provide a fluid tight seal. The second inner container 40 is formed from a flexible material for enabling an external pressure from the aerosol propellant 19 to propel the second fluid product 12 from the second inner container 40. The flexible material of the second inner container 40 enables the second inner container 40 to be inserted into the aerosol container 20 through the mounting cup opening 27. The second inner container 40 is secured to the aerosol container 20 by a connector 45.

The aerosol dispenser 10 includes a mounting cup 50 having a peripheral rim 52 for sealing to the bead 26 of the aerosol container 20. A rim sealing gasket 54 provides a fluid tight seal between the rim 52 of the mounting cup 50 and the bead 26 of the aerosol container 20. Preferably, the rim 52 of the mounting cup 50 is crimped to the bead 26 of the aerosol container 20 in a conventional fashion for sealably securing the mounting cup 50 to the aerosol container 20. The mounting cup 50 includes a turret 56 for receiving the aerosol valve 14. A valve sealing gasket 58 seals the aerosol valve 14 to the mounting cup 50. The valve sealing gasket 58 includes a central aperture 59.

The aerosol valve 14 includes a valve stem 60 extending through the central aperture 59 of the valve sealing gasket 58. The valve stem 60 supports the actuator 16 for discharging the first and second fluid products 11 and 12 from the terminal orifice 18. Preferably, the aerosol dispenser 10 includes a mixer 65 for mixing the first and second fluid products 11 and 12 prior to discharge from the terminal orifice 18. The valve actuator 16 may be covered by a protective overcap or cover (not shown) for preventing accidental actuation of the aerosol valve 14 during shipping and/or to prevent accidental actuation by a consumer.

The first and second inner containers 30 and 40 are flexible inner containers for enabling the aerosol propellant 19 located within the aerosol container 20 to apply an equal pressure to both the first and second inner containers 20 and 30. Upon actuation of the aerosol valve 14, the first and second fluid products 11 and 12 pass through the aerosol valve 14. The improved aerosol valve 14 enables the first and second fluid products 11 and 12 to be simultaneously dispensed from the aerosol container 20.

The mixer 65 mixes the first and second fluid products 11 and 12 prior to being discharged from the terminal orifice 18. The mixture of the first and second fluid products 11 and 12 are expelled from the terminal orifice 18 without any expulsion of the propellant 13. The first and second inner containers 20 and 30 collapse as the first and second fluid products 11 and 12 are depleted therefrom.

Figure 2:
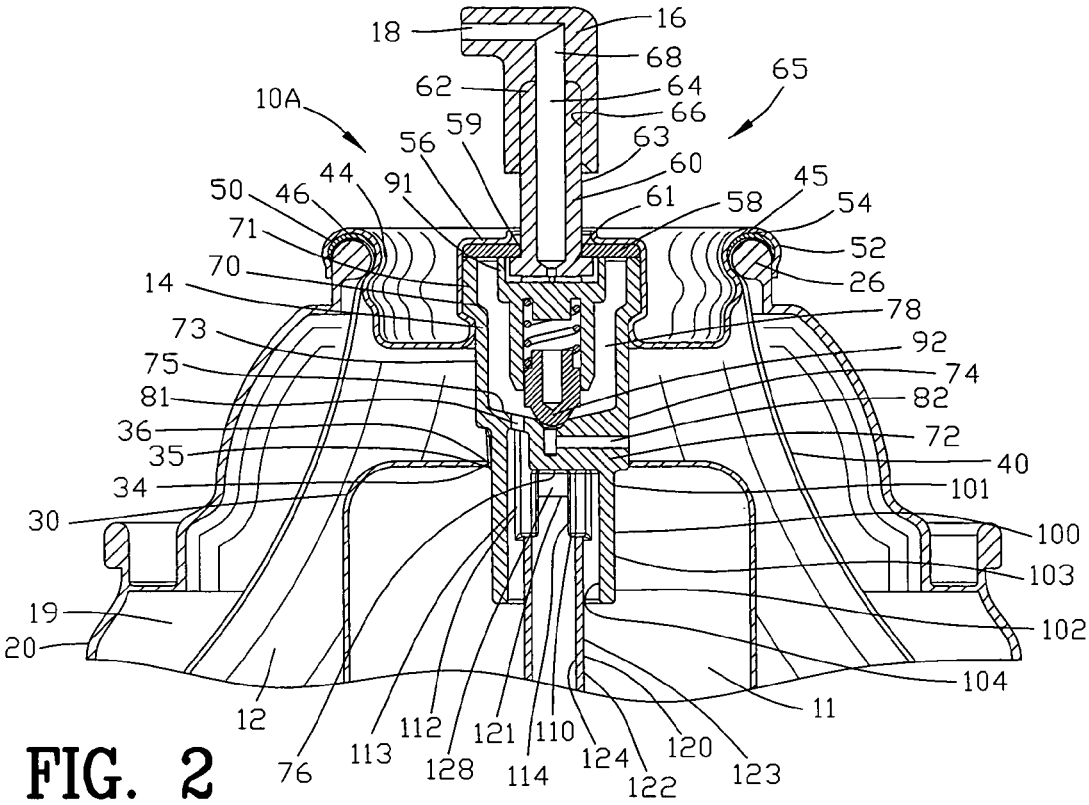
FIG. 2 is an enlarged view of a first embodiment of the improved aerosol dispenser shown in FIG. 1.

FIG. 2 is an enlarged view of a first embodiment of an improved aerosol dispenser 10A shown in FIG. 1. The valve stem 60 extends between a first end 61 and a second end 62. The valve stem 60 defines an outer surface 63 with a stem passageway 64 extending therein. The actuator 16 includes a socket 66 for frictionally receiving the first end 61 of the valve stem 60. The actuator 16 includes an actuator passage 68 interconnecting the socket 66 to the terminal orifice 18. The socket 66 of the actuator 16 is frictionally secured to the valve stem 60 for enabling the actuator 16 to open the aerosol valve 14.

The aerosol valve 14 includes a valve body 70 having a top portion 71 and a bottom portion 72 with a sidewall 73 extending therebetween. The bottom portion 72 of the valve body 70 includes an endwall 74 defining an inner surface 75 and an outer surface 76. The valve body 70 defines an internal valve cavity 78 for controlling the flow of the first and second fluid products 11 and 12 through the aerosol valve 14.

The top portion 71 of valve body 70 is secured to the turret 56 of the mounting cup 50 with the valve sealing gasket 58 providing a fluid tight seal with the mounting cup 50.

Preferably, the first end 71 of the valve body 70 is crimped to the turret 56 of the mounting cup 50 in a conventional fashion with the valve sealing gasket 58 disposed therebetween.

The valve body 70 includes a first and a second channel 81 and 82 for providing fluid communication with the internal valve cavity 78 of the valve body 70. In this example of the invention, the first channel 81 is defined within the endwall 74 of the valve body 70 and the second channel 82 is defined within the sidewall 73 of the valve body 70. The first and second channels 81 and 82 provide independent paths into the internal valve cavity 78 of the valve body 70 of the aerosol valve 14.

The bottom portion 72 of the valve body 70 is secured to the first inner container 30 for providing fluid communication solely between the first inner container 30 and the first channel 81 of the aerosol body 70. In this example of the invention, the first inner container 30 is secured to the sidewall 73 of the valve body 70 below the location of the second channel 82.

The first inner container 30 is shown as a metallic foil pouch with the top portion 31 of first inner container 30 secured to the bottom portion 72 of the valve body 70 by the connector 35 such as a weld 36. Although the first inner container 30 is shown secured to the valve body 70 by the weld 36, it should be understood that the first inner container 30 may be secured to the valve body 70 by any number of ways such as sonic welding, adhesives, radio frequency welding, laser welding, mechanical fasteners such as mechanical clamps, friction or by any other suitable means.

The second inner container 40 is mounted to provide fluid communication solely between the second inner container 40 and the second channel 82 of the valve body 70. In this first embodiment of the invention, the second inner container opening 44 in the top portion 41 of the second inner container 40 defines the connector 45 shown as a rim 46. The rim 46 is established to sealingly engage with the bead 26 of the aerosol container 20. The rim 46 is located between the bead 26 of the aerosol container 20 and the rim 52 of the mounting cup 50. The rim 46 of the second inner container 40 may function as a sealing gasket between the bead 26 of the aerosol container 20 and the rim 52 of the mounting cup 50 to replace the conventional rim sealing gasket 54 as should be well known to those skilled in the art. Although the second inner container 40 is shown secured to the aerosol container 20 by the rim 46, it should be understood that the second inner container 40 may be secured to the aerosol container 20 or the valve body 70 by any number of way such as sonic welding, adhesives, radio frequency welding, laser welding, mechanical fasteners such as mechanical clamps, friction or by any other suitable means.

The aerosol valve 14 includes a first and a second valve element 91 and 92 disposed in the internal valve cavity 78 of the valve body 70. The first valve element 91 is positioned to regulate the flow of the first fluid product 11 from the first inner container 30 through the first channel 81. Similarly, the second valve element 92 is positioned to regulate the flow of the second fluid product 12 from the second inner container 40 through the second channel 82.

In this first embodiment of the invention, the valve body 70 includes a cylindrical member 100 extending from a proximal end 101 to a distal end 102 and defining an outer surface 103 and an inner surface 104. The proximal end 101 of the cylindrical member 100 is secured to the bottom portion 72 of the valve body 70 with the distal end 102 extending downwardly therefrom.

A plurality of projections 110 extend from the bottom endwall 74 of the valve body 70 within the inner surface 104 of the cylindrical member 100. The plurality of projections 110 extending only partially to the distal end 102 of the cylindrical member 100. The plurality of projections 110 define spaces 112 between the adjacent plurality of projections 110. The plurality of projections 110 further define outer surfaces 113 and inner surfaces 114.

An optional sleeve 120 extends between a proximal end 121 and a distal end 122 and defining an outer sleeve surface 123 and an inner sleeve surface 124. The proximal end 121 of the sleeve 120 is secured to the plurality of projections 110 with the distal end 122 extending downwardly therefrom. In this example of the invention, the outer sleeve surface 123 is frictionally secured to the inner surfaces 114 of the plurality of projections 110. The proximal end 121 of the sleeve 120 is spaced from the bottom endwall 74 of the valve body 70 from creating a void 128.

As best shown in FIG. 1, the distal end 122 of the sleeve 120 extends into the interior of the first inner container 30 in proximity to the bottom portion 32 of the first inner container 30. The sleeve 120 provides three independent functions for the aerosol dispenser 10A. First, the sleeve 120 provides a support for rolling the first inner container 30 onto the sleeve 120 for facilitating the insertion of the aerosol valve 14 with the attached first inner container 30 into the second inner container 40 and/or the mounting cup opening 27 in the aerosol container 20. Second, the sleeve 120 insures the uniform collapse of the first inner container 30 as the first fluid product 11 is depleted from the first inner container 30. Third, the sleeve 120 provides a fluid passage from the bottom of the first inner container 30 to the first channel 81 in the event the first inner container 30 totally collapses in proximity to the distal end 102 of the cylindrical member 100.

Figure 3:
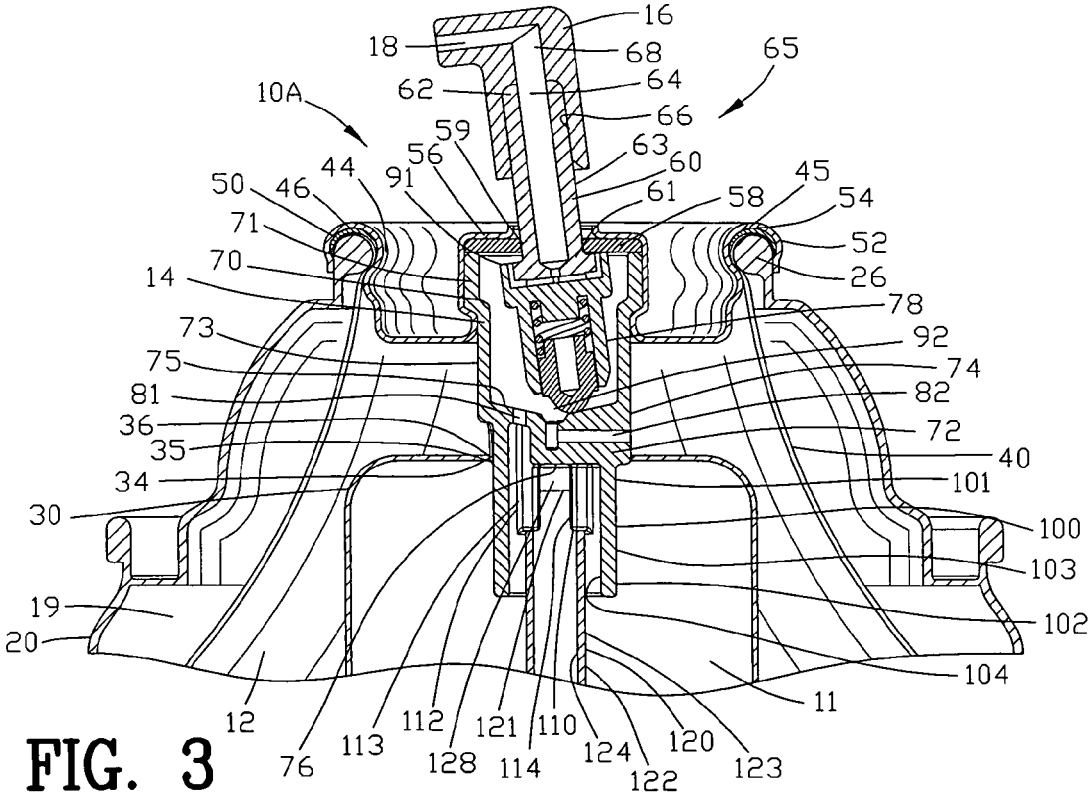
FIG. 3 is a view similar to FIG. 2 illustrating the improved aerosol dispenser in an actuated position for discharging the mixed first and second fluid products.

FIG. 3 is a view similar to FIG. 2 illustrating the improved aerosol dispenser 10A in an actuated position for discharging the mixture of the first and second fluid products 11 and 12. When the actuator 16 is moved into an actuated position, aerosol valve 14 simultaneously moves the first and second valve elements 91 and 92 for providing simultaneous flow and mixing of the first and second fluid products 11 and 12. The aerosol propellant 19 located within the aerosol container 20 applies an equal pressure to both the first and second inner containers 20 and 30.

The mixer 65 is located in the aerosol valve 14 and/or the actuator 16 mixes the first fluid product 11 with the second fluid product 12 prior to being discharged from the terminal orifice 18. The mixed first and second fluid products 11 and 12 are expelled from the terminal orifice 18 without the expulsion of the propellant 13.

Figure 4:
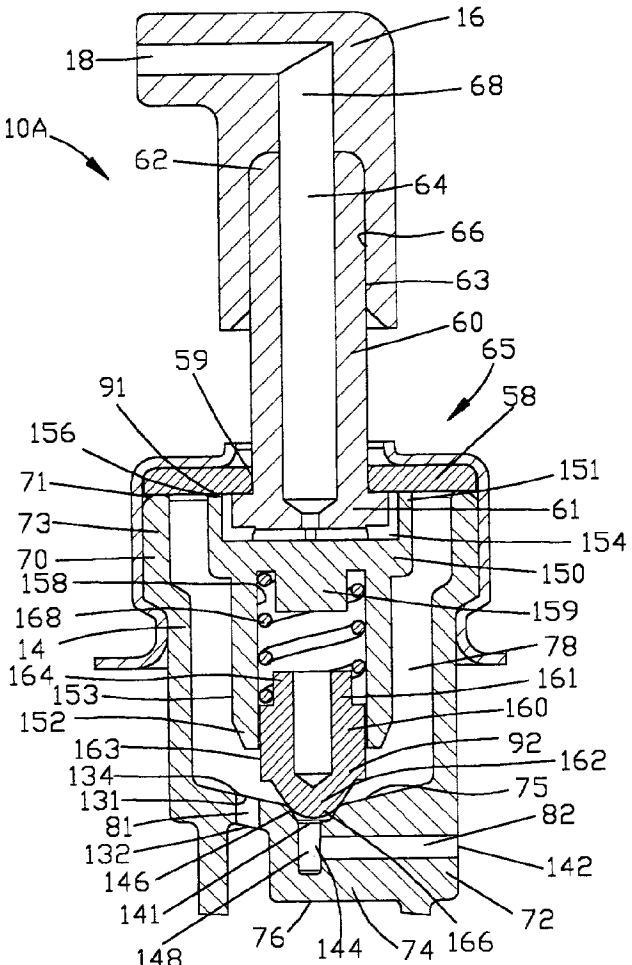
FIG. 4 is an enlarged partial view of FIG. 2.
Figure 8:
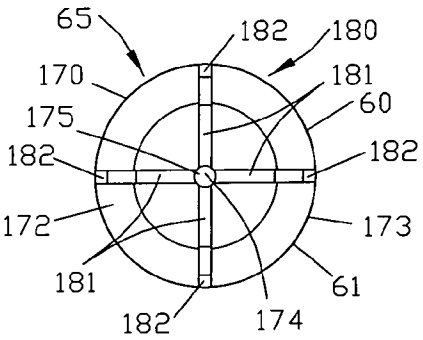
FIG. 8 is a view along line of 8-8 in FIG. 7.
Figure 9:
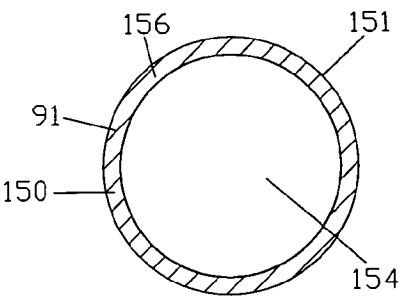
FIG. 9 is a view along line of 9-9 in FIG. 7.
Figure 7:
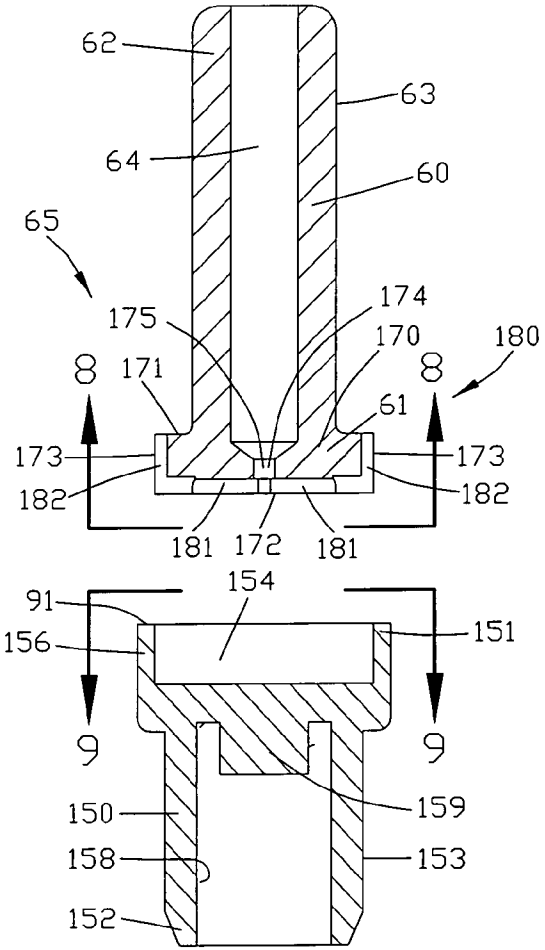
FIG. 7 is an exploded view of FIG. 6.
Figure 6:
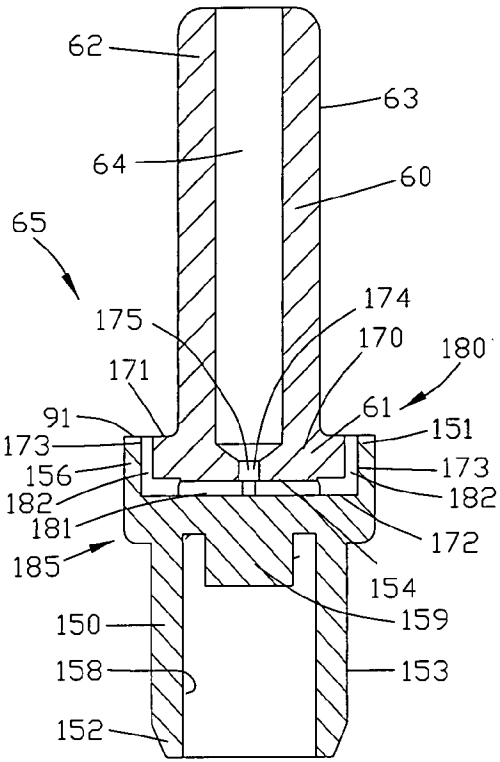
FIG. 6 is an enlarged view of a portion of FIG. 4.

FIG. 4 is an enlarged partial view of FIG. 2. The first channel 81 extends between an inner end 131 and an outer end 132 through the bottom endwall 74 of the valve body 70. The inner end 131 of the first channel 81 terminates at the inner surface 75 of the valve body 70. Preferably, the first channel 81 has a metering region 134 having a selected cross-section for metering the flow of the first fluid product 11 through the first channel 81.

The second channel 82 extends between an inner end 141 and an outer end 142. The outer end 142 of the second channel 82 is located in the sidewall 73 of the valve body 70. Preferably, the second channel 82 has a metering region 144 having a selected cross-section for metering the flow of the second fluid product 12 through the second channel 82. The inner end 141 of the second channel 82 terminates with a sealing seat 146 located at the inner surface 75 of the valve body 70. An elbow bend 148 communicates the inner end 141 with the outer end 142 of the second channel 82.

Preferably, the cross-section of the metering region 134 of the first channel 81 and the cross-section of the metering region 144 of the second channel 82 are selected to provide the proper ratio of the first fluid product 11 relative to the second fluid product 12. The equal pressure applied to both the first and second inner containers 20 and 30 in combination with the first and second channels 81 and 82 and/or the metering regions 134 and 144 insure the proper proportions of the first and second fluid products 11 and 12 enter into the internal valve cavity 78 of the valve body 70.

In this first embodiment of the invention, the aerosol valve 14A comprises a valve element base 150 extending between a first and a second end 151 and 152 and bounded by an outer sidewall 153. The first end of the valve element base 150 includes a recess 154 defining an annular projection 156. The annular projection 156 terminates in an annular surface forming the first valve element 91 for providing a fluid tight seal with the valve sealing gasket 58. The annular projection 156 engages with the scaling gasket 58 for sealing the first channel 81 to inhibit the flow of the first fluid product 11.

The second end 152 of the valve element base 150 defines a cylindrical bore 158. A post 159 extends from the valve element base 150 within the cylindrical bore 158. A movable plug 160 is slidably located within the cylindrical bore 158. The movable plug 160 extends between a first and a second end 161 and 162 and defines a cylindrical sidewall 163. The first end 161 of the movable plug 160 includes a post 164. The second end 162 of the movable plug 160 includes a tapered end 166 forming the second valve element 92. The second valve element 92 engages with the sealing seat 146 for sealing the second channel 82 to inhibit the flow of the second fluid product 12.

A bias spring 168 is located between the post 159 extending from the valve element base 150 and the post 164 extending from the first end 161 of the movable plug 160. Preferably, the engagement of the bias spring 168 with the posts 159 and 164 retain the movable plug 160 with the valve element base 150 during the assembly of the aerosol valve 14A.

The bias spring 168 biases the first and second valve elements 91 and 92 to a closed position shown in FIGS. 2 and 4 to inhibit the flow of the first and second fluid products 11 and 12 through the first and second channels 81 and 82. More specifically, the bias spring 168 biases the first valve element 91 of the annular projection 156 into sealing engagement with the valve sealing gasket 58 to inhibit the flow of the first fluid product 11. Simultaneously therewith, the bias spring 168 biases the second valve element 92 into sealing engagement with the sealing seat 146 of the second channel 82 to inhibit the flow of the second fluid product 12.

Figure 5:
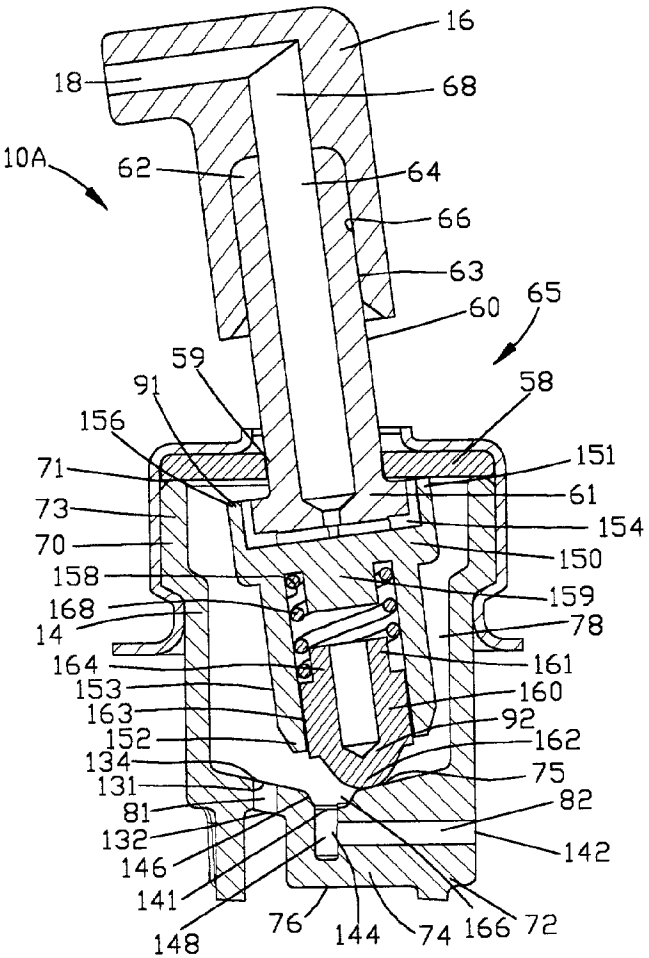
FIG. 5 is an enlarged partial view of FIG. 3.

FIG. 5 is an enlarged partial view of FIG. 3. The aerosol valve 14A is shown as a tilt valve wherein the tilting the actuator 16 tilts the valve stem 60 of the aerosol valve 14. The tilting of the valve stem 60 displaces the first and second valve elements 91 and 92 from a biased closed position shown in FIGS. 2 and 4 to the open position shown in FIGS. 3 and 5. The tilting of the valve stem 60 simultaneously displaces the first and second valve elements 91 and 92 for providing simultaneous flow of the first and second fluid products 11 and 12 through the first and second channels 81 and 82. The first valve element 91 of the annular projection 156 is move away from the valve sealing gasket 58 to enable the flow of the first fluid product 11. Simultaneously therewith, the second valve element 92 is move away from the sealing seat 146 of the second channel 82 to enable the flow of the second fluid product 12.

FIGS. 6-9 are various enlarged views of the valve stem 60 shown in FIGS. 1-5. The inner end 61 of the valve stem 60 includes an enlarged flange 170 comprising a first and a second surface 171 and 172 with a peripheral surface 173 located therebetween. The enlarged flange 170 is adapted to be received within the recess 154 in the valve element base 150. Preferably, the enlarged flange 170 forms an interference fit with the recess 154 for securing the valve stem 60 to the valve element base 150.

The valve stem 60 includes a valve stem port 174 communicating with the stem passageway 64 of the valve stem 60. A valve stem port 174 provides fluid communication between the internal cavity 78 of the valve body 70 and the stem passageway 64 of the valve stem 60. The valve stem port 174 may include a metering region 175 for metering the mixture of the first and the second fluid products 11 and 12. The metering region 175 has a cross-section selected for metering the flow of the mixture of the first and second fluid products 11 and 12 into the stem passageway 64.

FIGS. 6-9 further illustrate the mixer 65 of the improved aerosol dispenser 10A. In this embodiment of the invention, the mixer 65 is located on the enlarged flange 170 of the inner end 61 of the valve stem 60. The mixer 65 comprises the plurality of grooves 180 uniformly distributed about the enlarged flange 170. The plurality of grooves 180 insure the proper mixing of the first fluid product 11 with the second fluid product 12 prior to being discharged from the terminal orifice 18.

Each of the plurality of grooves comprises a radial component 181 and an axial component 182. Each of the radial components 181 extends radially outwardly from the stem passageway 64 of the valve stem 60. The radial components 181 extend substantially perpendicular to the stem passageway 64 of the valve stem 60. Each of the radial components 181 communicates with the valve stem port 174 of the valve stem 60. Each of the axial components 182 extends substantially parallel to the stem passageway 64 of the valve stem 60 along the peripheral surface 173 of the enlarged flange 170. Each of the axial components 182 communicates through a radial component 181 to the stem passageway 64 of the valve stem 60.

When the enlarged flange 170 is secured within the recess 154 in the valve element base 150, the second surface 172 and the peripheral surface 173 cooperates with the recess 154 for enclosing the plurality of grooves 180 to form a plurality of mixing channels 185. The plurality of mixing channels 185 and the valve stem port 174 provides fluid communication between the internal cavity 78 of the valve body 70 and the stem passageway 64 of the valve stem 60. The plurality of mixing channels 185 cause a turbulent flow of the first fluid product 11 with the second fluid product 12 through each of the plurality of mixing channels 185. The turbulent flow of the first and second fluid products 11 and 12 through each of the plurality of mixing channels 185 insures the proper mixing of the first and second fluid products 11 and 12 prior to being discharged from the terminal orifice 18. In addition, the plurality of mixing channels 185 insures the proper time period of mixing to achieve any desired chemical reaction between the first and second fluid products 11 and 12.

Figure 10:
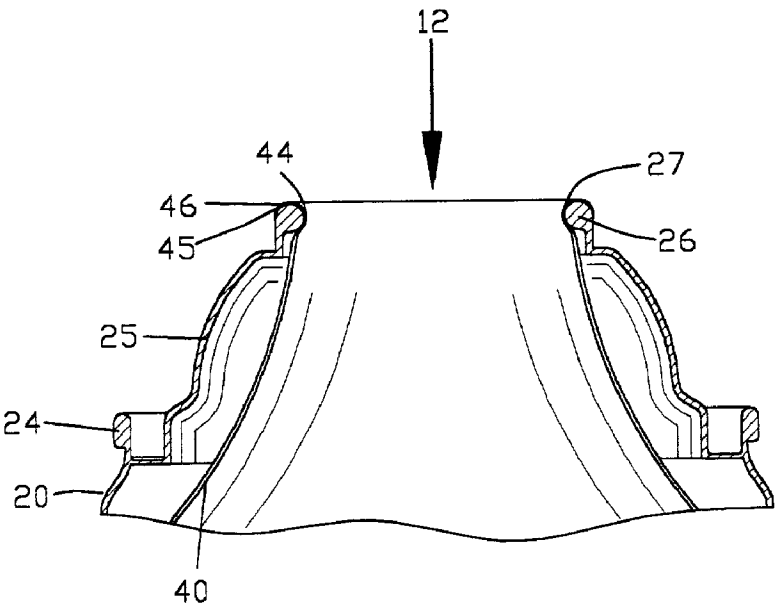
FIG. 10 is a side sectional view illustrating the filling of the second fluid product into a second inner container.

FIG. 10 is a side sectional view illustrating the filling of the second inner container 40 with the second fluid product 12. The second inner container 40 is inserted into the aerosol container 20 through the mounting cup opening 27. The second inner container 40 is secured to the aerosol container 20 by the connector 45 shown as rim 46. The second fluid product 12 is introduced into the second inner container 40 through the second inner container opening 44 as indicated by the arrow. In the alternative, second fluid product 12 may be introduced into the second inner container 40 through a process commonly referred to as an under-the-cap (UTC) filling process.

Figure 11:
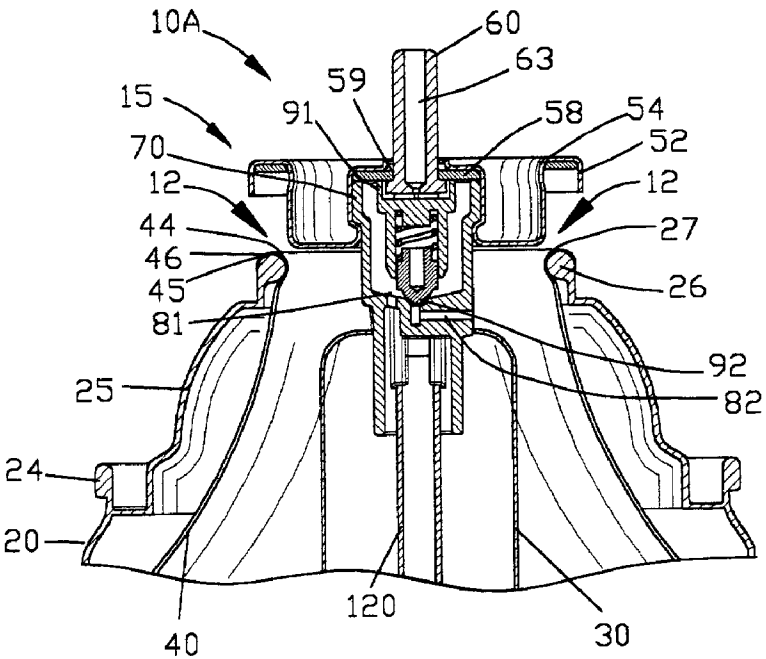
FIG. 11 is a side view illustrating the insertion of the improved aerosol dispenser into the aerosol container.

FIG. 11 is a side view illustrating the insertion of the improved aerosol dispenser 14A into the aerosol container 20. The first inner container 30 is shown in an unfilled and collapsed condition for enabling the first inner container 30 to be inserted through the second inner container opening 44 of the second container 40. The first inner container 30 may be rolled about the sleeve 120 for enabling insertion into the second container 40.

The partial insertion of the improved aerosol dispenser 10A within the aerosol container 20 illustrates a position suitable for an under-the-cap (UTC) filling process. The second fluid product 12 may be introduced into the second inner container 40 between the second inner container opening 44 and the mounting cup 50 as indicated by the arrows.

Figure 12:
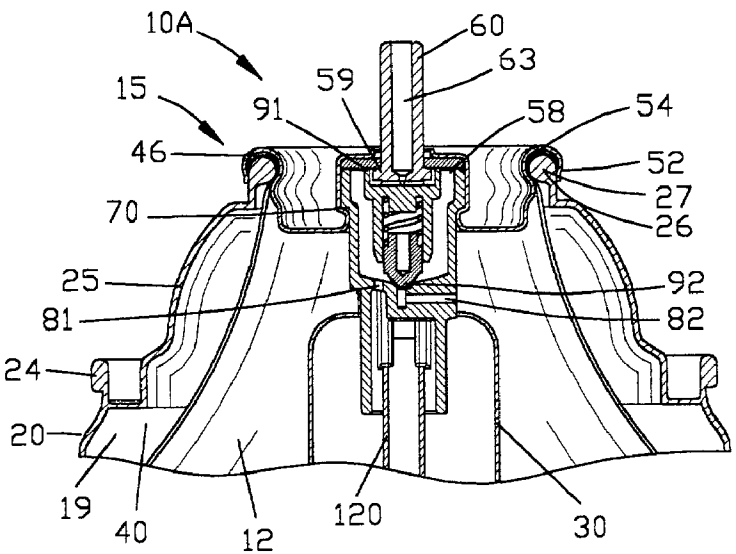
FIG. 12 is a view similar to FIG. 11 illustrating the crimping of the improved aerosol dispenser to the aerosol container.

FIG. 12 is a view similar to FIG. 11 illustrating the crimping of the improved aerosol dispenser 14A to the aerosol container 20. The peripheral rim 52 of the mounting cup 50 is crimped to the bead 26 of the aerosol container 20 in a conventional fashion. The rim sealing gasket 54 provides a fluid tight seal between the rim 52 of the mounting cup 50 and the bead 26 of the aerosol container 20.

Figure 13:
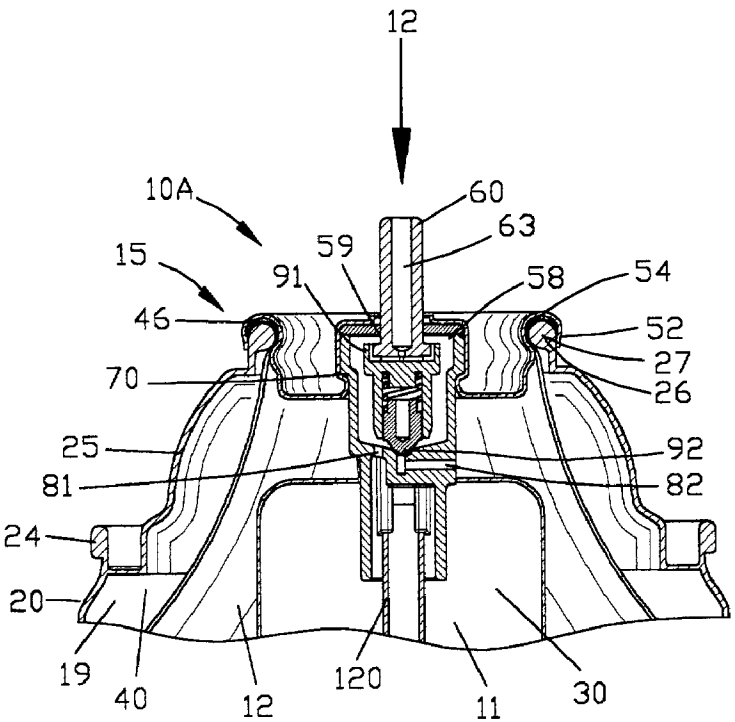
FIG. 13 is a view similar to FIG. 12 illustrating the filling of the first fluid product into a second inner container.

FIG. 13 is a view similar to FIG. 12 illustrating the filling of the second inner container 30 with the first fluid product 11. The first fluid product 11 is introduced into the first inner container 30 through the stem passageway 64 of the valve stem 60. The valve stem 60 is depressed vertically for opening the first valve elements 91 without opening the second valve element 91.

The vertical depression of the valve stem 60 displaces the annular projection 156 from the valve sealing gasket 58 to enable the flow of the first fluid product 11 into the first inner container 30. The vertical depression of the valve stem 60 does not displace the second valve element 92 from the sealing seat 146 of the second channel 82 of the valve body 70. The second valve element 92 prevents the first fluid product 11 from entering the second inner container 40 upon a vertical depression of the valve stem 60.

When the valve stem 60 is vertically depressed, the first fluid product 11 flows under filling pressure from the valve stem 60 through the internal valve cavity 78 and the first channel 81 of the valve body 70 into the first inner container 30. The first inner container 30 expands within the second inner container 40 as the first fluid product 11 fills the first inner container 30.

The propellant 19 is introduced into the aerosol container 20 through the opening in the one-way filling valve located in the endwall 28 of the aerosol container 20. The propellant 19 provides equal pressure to both the first and second inner containers 30 and 40.

FIGS. 14-17 are enlarged views of a second embodiment of an improved aerosol dispenser 10B shown in FIG. 1. The improved aerosol dispenser 10B shown in FIGS. 14-17 comprises a different aerosol valve 14B, a different actuator 16B, a different valve stem 60B, a different mixer 65B and a different first and second valve element 91B and 92B from the improved aerosol dispenser 10A shown in FIGS. 2-5.

The valve stem 60B extends between a first and a second end 61B and 62B. The valve stem 60B defines an outer surface 63B with a stem passageway 64B extending therein. The actuator 16B includes a socket 66B for frictionally receiving the first end 61B of the valve stem 60B. The actuator 16B includes an actuator passage 68B interconnecting the socket 66B to the terminal orifice 18B for enabling the actuator 16B to open the aerosol valve 14B.

The aerosol valve 14B includes a first and a second valve element 91B and 92B disposed in the internal valve cavity 78 of the valve body 70. The first valve element 91B is positioned to regulate the flow of the first fluid product 11 from the first inner container 30 through the first channel 81. Similarly, the second valve element 92B is positioned to regulate the flow of the second fluid product 12 from the second inner container 40 through the second channel 82.

Figure 14:
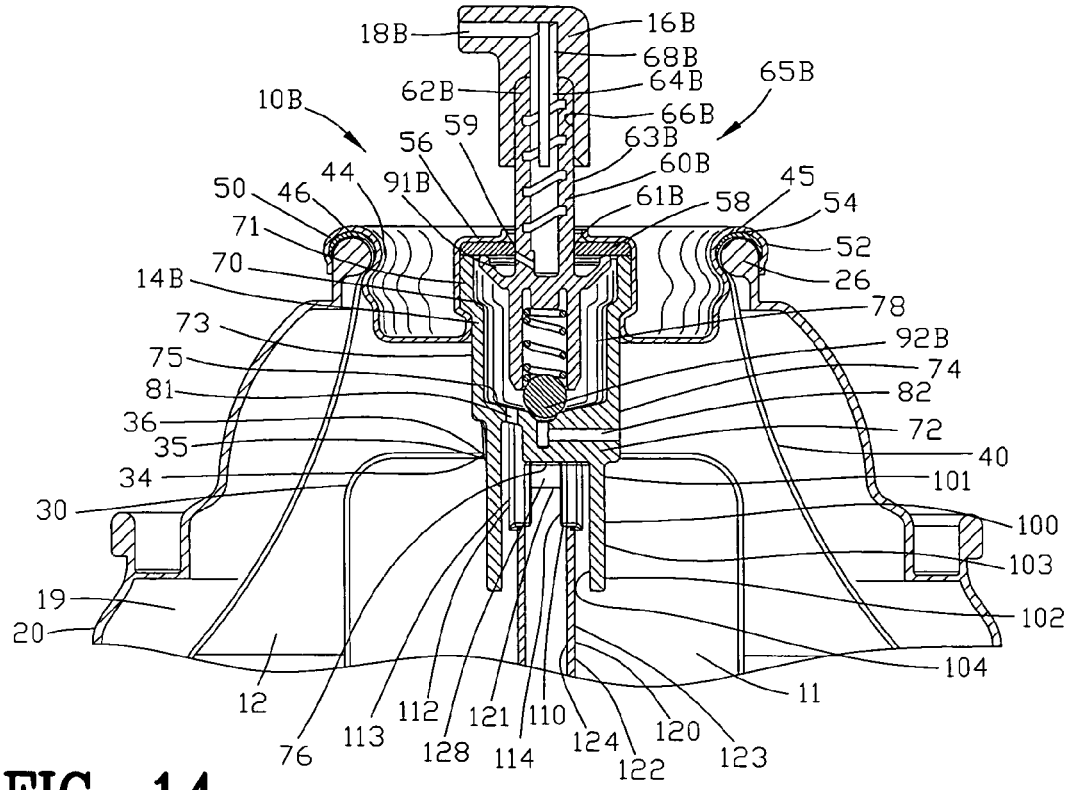
FIG. 14 is an enlarged view of a second embodiment of the improved aerosol dispenser shown in FIG. 1.
Figure 15:
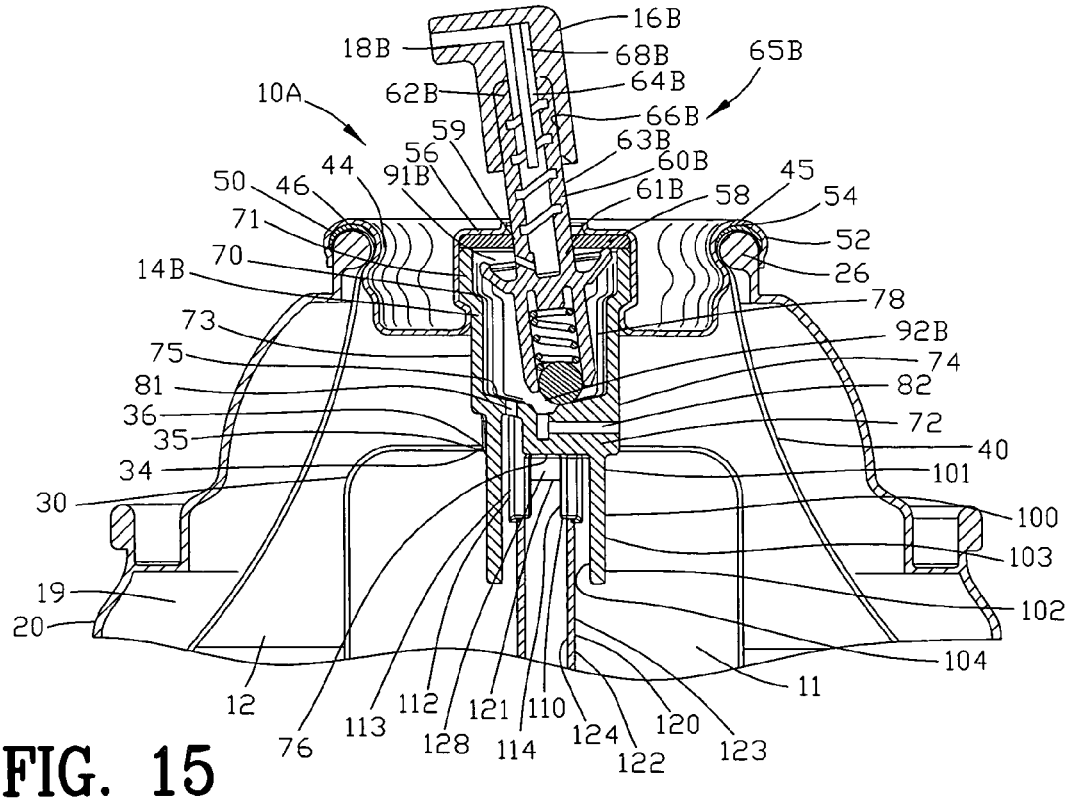
FIG. 15 is a view similar to FIG. 14 illustrating the improved aerosol dispenser in an actuated position discharging the mixed first and second fluid products.

FIG. 15 is a view similar to FIG. 14 illustrating the improved aerosol dispenser 10B in an actuated position for discharging the mixture of the first and second fluid products 11 and 12. When the actuator 16B is moved into an actuated position, aerosol valve 14B simultaneously moves the first and second valve elements 91B and 92B for providing simultaneous flow and mixing of the first and second fluid products 11 and 12. The aerosol propellant 19 located within the aerosol container 20 applies an equal pressure to both the first and second inner containers 20 and 30.

In this embodiment of the invention, the mixer 65B is located in the valve stem 60B and/or the actuator 16B for mixing the first fluid product 11 with the second fluid product 12 prior to being discharged from the terminal orifice 18.

Figure 16:
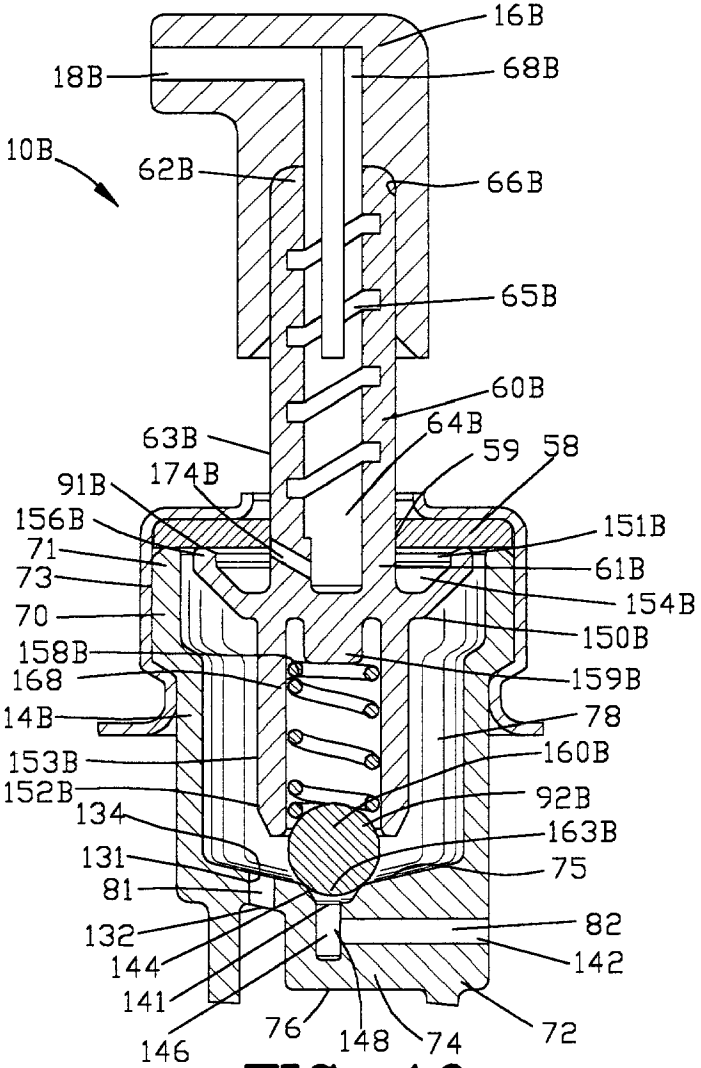
FIG. 16 is an enlarged partial view of FIG. 14.

FIG. 16 is an enlarged partial view of FIG. 14. In this second embodiment of the invention, the aerosol valve 14B comprises a valve element base 150B extending between a first and a second end 151B and 152B and bounded by an outer sidewall 153B. The first end 151B of the valve element base 150B includes a recess 154B defining an annular projection 156B. The annular projection 156B terminates in an annular surface forming the first valve element 91B for providing a fluid tight seal with the valve sealing gasket 58. The annular projection 156B engages with the sealing gasket 58 for sealing the first channel 81 to inhibit the flow of the first fluid product 11.

The second end 152B of the valve element base 1SOB defines a cylindrical bore 158B. A post 159B extends from the valve element base 150B within the cylindrical bore 158B. A movable sphere 160B is slidably located within the cylindrical bore 158B. The movable sphere 160B has a spherical outer surface 163B for forming the second valve element 92B. The spherical outer surface 163B of the movable sphere 160B forms the second valve element 92B to engage with the sealing seat 146 for sealing the second channel 82 to inhibit the flow of the second fluid product 12. The movable sphere 160B provides a simple and low cost valve for the second fluid product 12. The spherical outer surface 163B of the movable sphere 160B enhances the movement from the sealing seat 146.

A bias spring 168 is located between the post 159B extending from the valve element base 150B and the movable sphere 160B. The bias spring 168 biases the first and second valve elements 91B and 92B to the closed position shown in FIGS. 14 and 16 to inhibit the flow of the first and second fluid products 11 and 12 through the first and second channels 81 and 82. More specifically, the bias spring 168 biases the first valve element 91B of the annular projection 156B into sealing engagement with the valve sealing gasket 58 to inhibit the flow of the first fluid product 11. Simultaneously therewith, the bias spring 168 biases the second valve element 92B into sealing engagement with the sealing seat 146 of the second channel 82 to inhibit the flow of the second fluid product 12.

In this embodiment of the invention, the valve stem 60B is integrally formed with the valve element base 150B as a single one-piece unit. The valve stem 60 includes a valve stem port 174B communicating with the stem passageway 64B of the valve stem 60B.

Figure 17:
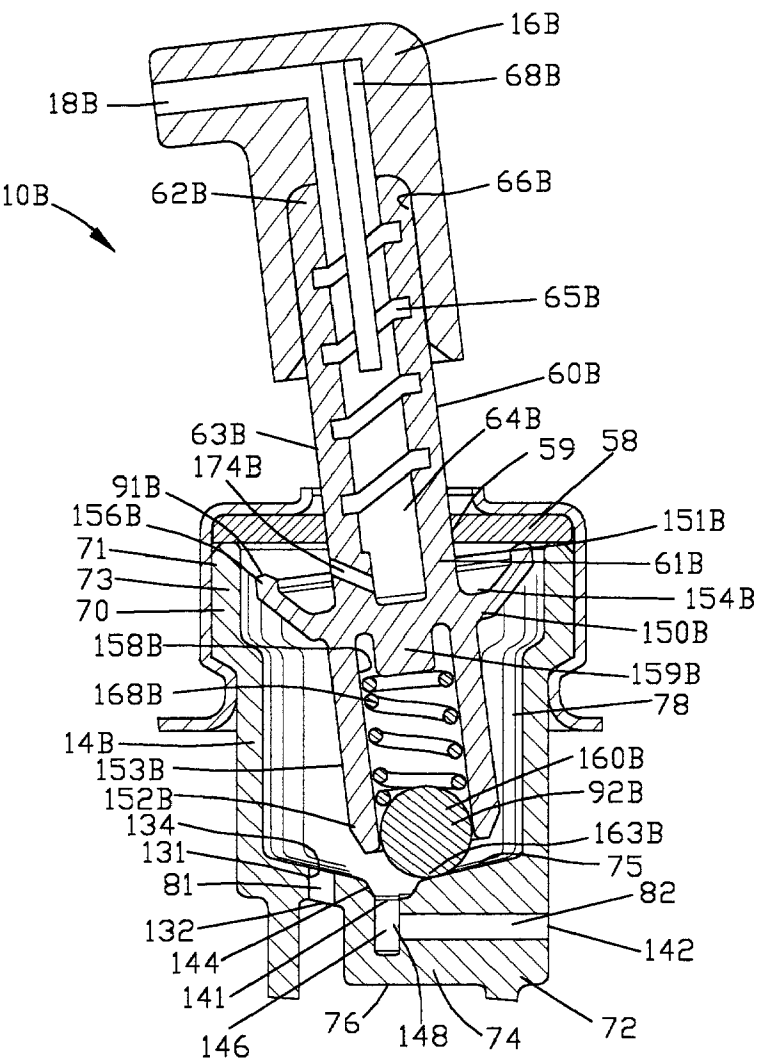
FIG. 17 is an enlarged partial view of FIG. 15.

FIG. 17 is an enlarged partial view of FIG. 15. The aerosol valve 14B is shown as a tilt valve wherein the tilting the actuator 16B tilts the valve stem 60B of the aerosol valve 14B. The tilting of the valve stem 60B displaces the first and second valve elements 91B and 92B from a biased closed position shown in FIGS. 14 and 16 to the open position shown in FIGS. 15 and 17. The tilting of the valve stem 60B simultaneously displaces the first and second valve elements 91B and 92B for providing simultaneous flow of the first and second fluid products 11 and 12 through the first and second channels 81 and 82. The first valve element 91B of the annular projection 156B is move away from the valve sealing gasket 58 to enable the flow of the first fluid product 11. Simultaneously therewith, the second valve element 92B is move away from the sealing seat 146 of the second channel 82 to enable the flow of the second fluid product 12.

Figure 18:
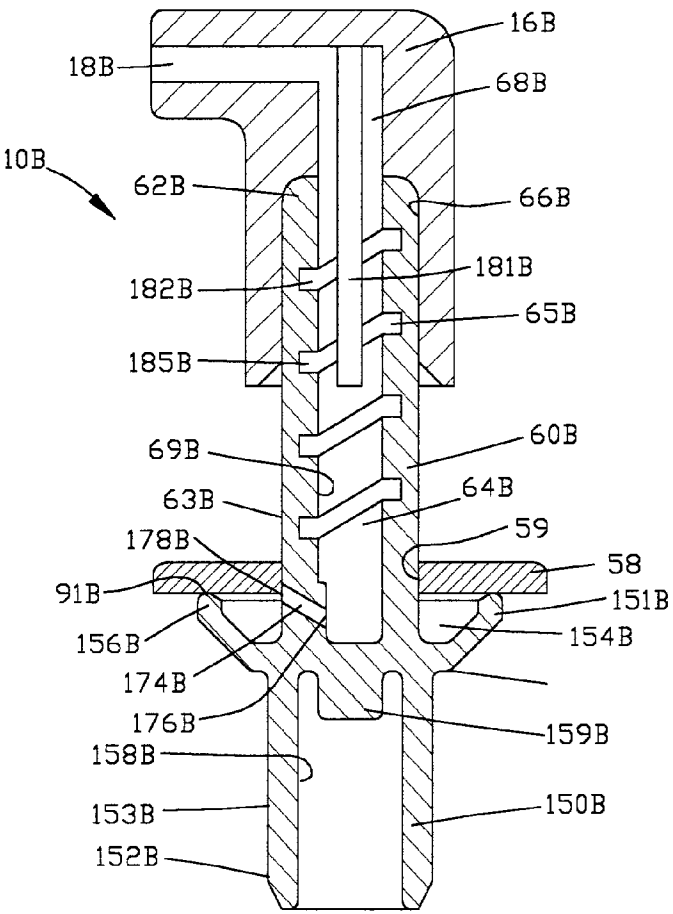
FIG. 18 is view similar to FIG. 16 illustrating a third embodiment of the improved aerosol dispenser of the present invention.

FIG. 18 is an enlarged view of a portion of FIG. 16. The valve stem port 174B extends between an inner end 176B and an outer end 178B. The inner end 176B of the valve stem port 174B communicates directly with the stem passageway 64B of the valve stem 60B. The outer end 178B of the valve stem port 174B communicates directly with the internal valve cavity 78 of the valve body 70.

The valve stem port 174B is orientated at an acute angle relative to the stem passageway 64B of the valve stem 60B. The outer end 178B of the valve stem port 174B is located above the level of the annular projection 156B of the valve element base 150B in FIG. 16. The inner end 176B of the valve stem port 174B is located below the level of the outer end 178B of the valve stem port 174B in FIG. 16. The angular orientation of the valve stem port 174B facilitates the molding of the valve stem 60B and the valve element base 150B as a single one-piece unit. The valve stem port 174B may include a metering region (not shown) for metering the mixture of the first and the second fluid products 11 and 12.

In this embodiment of the invention, the mixer 65B is located within the stem passageway 64B of the valve stem 60B and/or the actuator passage 68B of the actuator 16B. The mixer 65B comprises a post 181B extending from the actuator 16B in combination with a helical groove 182B defined within the stem passageway 64B of the valve stem 60B. The post 181B extends from the actuator 16B through the actuator passage 68B into the stem passageway 64B of the valve stem 60B. The helical groove 182B is defined within the sidewall surface 69B of the stem passageway 64B. The helical groove 182B cooperates with the post 181B to form a helical mixing channels 185B. The helical mixing channel 185B provides fluid communication between the internal cavity 78 of the valve body 70 and the terminal orifice 18B.

The helical mixing channel 185B causes a turbulent flow of the first fluid product 11 with the second fluid product 12 through the helical mixing channel 185B. The turbulent flow of the first and second fluid products 11 and 12 through the helical mixing channel 185B insures the proper mixing of the first and second fluid products 11 and 12 prior to being discharged from the terminal orifice 18B. In addition, the plurality of mixing channels 185B insures the proper time period of mixing to achieve any desired chemical reaction between the first and second fluid products 11 and 12.

Figure 19:
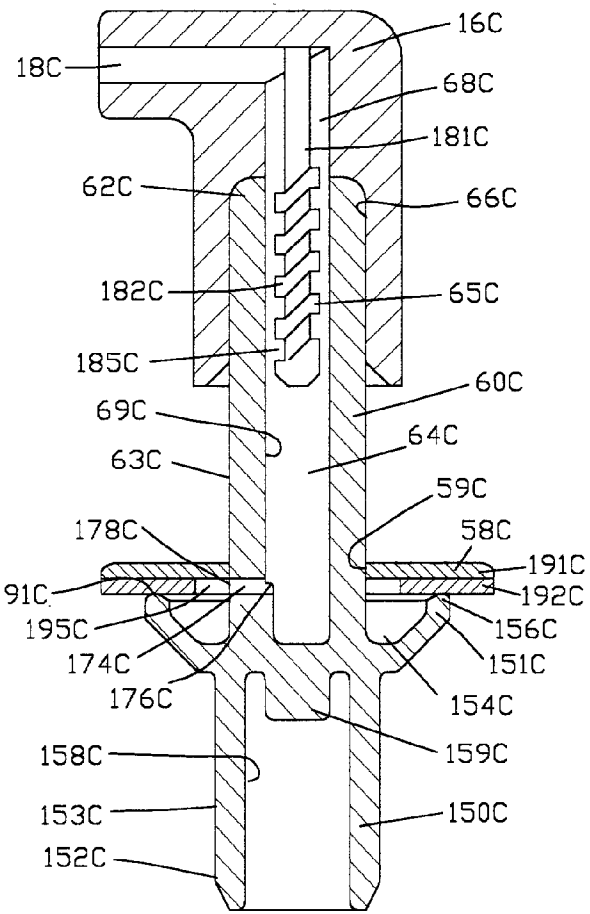
FIG. 19 is view similar to FIG. 16 illustrating a fourth embodiment of the improved aerosol dispenser of the present invention.

FIG. 19 is view similar to FIG. 18 illustrating an alternate mixer 65C for use with the aerosol dispenser device 10 of FIGS. 1-4. The valve stem port 174C extends between an inner end 176C and an outer end 178C. The inner end 176C of the valve stem port 174C communicates directly with the stem passageway 64C of the valve stem 60C. The outer end 178C of the valve stem port 174C communicates directly with the internal valve cavity 78 of the valve body 70.

The valve stem port 174C is orientated at a perpendicular angle relative to the stem passageway 64C of the valve stem 60C. The outer end 178C of the valve stem port 174C is located above the level of the annular projection 156C of the valve element base 150C. Similarly, the inner end 176C of the valve stem port 174C is located above the level of the annular projection 156C of the valve element base 150C.

The location of the valve stem port 174C facilitates the molding of the valve stem 60C and the valve element base 150C as a single one-piece unit. The valve stem port 174C may include a metering region (nor shown) for metering the mixture of the first and the second fluid products 11 and 12.

In this embodiment of the invention, the sealing gasket 58C comprises a first and a second sealing gasket 191C and 192C. The first sealing gasket 191C comprises a central aperture 59C for sealing with the outer surface 63B with a stem passageway 64B. The second sealing gasket 192C comprises an enlarged central aperture 195C for cooperating with the valve stem port 174C for enabling the mixed first and the second fluid products 11 and 12 to enter the stem passageway 64B of the valve stem 60.

In this embodiment of the invention, the mixer 65C is located within the stem passageway 64C of the valve stem 60C and/or the actuator passage 68C of the actuator 16C. The mixer 65C comprises a post 181C extending from the actuator 16C. The post 181C includes a helical groove 182C defined within the post 181C. The post 181C extends through the actuator passage 68C into the stem passageway 64C of the valve stem 60C. The helical groove 182C cooperates with a sidewall surface 69C of the stem passageway 64C to form a helical mixing channels 185C. The helical mixing channel 185C provides fluid communication between the internal cavity 78 of the valve body 70 and the terminal orifice 18B.

The helical mixing channel 185C causes a turbulent flow of the first fluid product 11 with the second fluid product 12 through the helical mixing channel 185C. The turbulent flow of the first and second fluid products 11 and 12 through the helical mixing channel 185C insures the proper mixing of the first and second fluid products 11 and 12 prior to being discharged from the terminal orifice 18C. In addition, the helical mixing channels 185C insures the proper time period of mixing to achieve any desired chemical reaction between the first and second fluid products 11 and 12.

An important aspect of the present invention is the incorporation of the first and second flexible inner containers 30 and 40 for containing the first and second fluid products 11 and 12 with the aerosol propellant 19 being contained within the aerosol container 20. The present invention enables the second inner container 40 to be filled with the second fluid 12 prior to the filling of the first inner container 30 with the first fluid 11.

The aerosol dispensing device 10 of the present invention enables the first and second fluid products 11 and 12 to be dispensed in any of a three hundred and sixty degree orientation. The three hundred and sixty degree dispensing capability is the result of the uniform pressure applied to the first and second inner containers 30 in 40 by the aerosol propellant 19. The aerosol dispensing device 10A is suitable also for dispensing products such as furniture polish or the like in a downward direction through the use of an appropriate actuator 16.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved aerosol dispenser for mixing and dispensing a first and a second fluid product from an aerosol container through a terminal orifice, the aerosol container having an annular bead defining an opening in the aerosol container, comprising:

a mounting cup having a peripheral rim for sealing with the annular bead of the aerosol container;

said mounting cup having a turret;

a valve sealing gasket having central aperture extending between opposed sides of said valve sealing gasket;

an aerosol valve body extending between a first and a second valve body end with a valve body cavity defined in said first valve body end;

said aerosol valve body being secured to said mounting cup with one of said sides of said valve sealing gasket engaging with said first valve body end and with the other of said sides of said valve sealing gasket engaging with said turret for sealing said aerosol valve body to the mounting cup;

a first channel defined in said valve body in proximity to said second valve body end for providing fluid communication with said valve body cavity;

a second channel defined in said valve body remote from said second valve body end for providing fluid communication with said valve body cavity;

a first flexible inner container secured to said second end of said valve body for communicating only with said first channel;

a second flexible inner container engaging with said annular bead of the aerosol container thereby defining a second inner container opening;

said second inner container opening enabling the second fluid to be introduced into said second inner container through said second inner container opening;

said first inner container being located within said second inner container when the peripheral rim of said mounting cup engages with said annular bead of said aerosol container and with said second channel being in fluid communication only with said second inner container;

a valve stem extending between a first and a second end and having an outer surface with a stem passageway extending between said first and second ends of said valve stem;

said first end of said valve stem defining an enlarged flange extending radially outwardly from said outer surface of said valve stem;

said valve stem slidably extending through said central aperture of said valve sealing gasket with said enlarged flange being located within said valve body cavity adjacent to said side of said valve sealing gasket engaging with said first valve body end for enabling a vertical depression of said valve stem;

said valve stem actuating a first and a second valve element disposed in said valve body cavity for controlling the flow of the first and second fluids through said valve body cavity;

a vertical depression of said valve stem opening only said first valve element for enabling the first fluid to be introduced under pressure into said first inner container; and a tilting of said valve stem simultaneously opening said first and second valve elements enabling the simultaneous mixing and dispensing of the first and second fluids from the terminal orifice.

2. An improved aerosol dispenser as set forth in claim 1, wherein said first channel is defined in an end of said aerosol valve body; and said second channel being defined in an sidewall of said aerosol valve body.

3. An improved aerosol dispenser as set forth in claim 1, including a constricted fluid passageway for mixing the first and the second fluids.

4. An improved aerosol dispenser as set forth in claim 1, including a bias spring interposed between said first and second valve elements for simultaneously biasing said first and second valve elements into sealing engagement with said first and second channels, respectively.

5. An improved aerosol dispenser as set forth in claim 1, wherein second valve element is movably mounted relative to said first valve element;

a bias spring interposed between said first and second valve elements for simultaneously biasing said first and second valve elements into sealing engagement with said first and second channels, respectively;

said first and second valve elements enabling the dispensing of the first and second fluids from the terminal orifice upon the tilting of said first and second valve elements.

6. An improved aerosol dispenser for mixing and dispensing a first and a second fluid product from an aerosol container through a terminal orifice, the aerosol container having an annular bead defining an opening in the aerosol container, comprising:

a mounting cup having a peripheral rim for sealing with the annular bead of the aerosol container;

said mounting cup having a turret;

a valve sealing gasket having central aperture extending between opposed sides of said valve sealing gasket;

an aerosol valve body extending between a first and a second valve body end with a valve body cavity defined in said first valve body end;

said aerosol valve body being secured to said mounting cup with one of said sides of said valve sealing gasket engaging with located between said first valve body end and with the other of said sides of said valve sealing gasket engaging with said turret for sealing said aerosol valve body to the mounting cup;

a first channel defined in said valve body in said first end of said aerosol valve body for providing fluid communication with said valve body cavity;

a second channel defined in a sidewall of said aerosol valve body for providing fluid communication with said valve body cavity;

a first flexible inner container secured to said second end of said valve body for communicating only with said first channel;

a second flexible inner container engaging with said annular bead of the aerosol container thereby defining a second inner container opening;

said second inner container opening enabling the second fluid to be introduced into said second inner container through said second inner container opening;

said first inner container passing through the opening in the aerosol container when the peripheral rim of said mounting cup is moved to the annular bead of the aerosol container;

said first inner container being located within said second inner container when the peripheral rim of said mounting cup engages with said annular bead of said aerosol container and with said second channel being in fluid communication only with said second inner container;

a valve stem extending between a first and a second end and having an outer surface with a stem passageway extending between said first and second ends of said valve stem;

said first end of said valve stem defining an enlarged flange extending radially outwardly from said outer surface of said valve stem;

said valve stem slidably extending through said central aperture of said valve sealing gasket with said enlarged flange being located within said valve body cavity adjacent to said side of said valve sealing gasket engaging with said first valve body end for enabling a vertical depression of said valve stem;

said valve stem actuating a first and a second valve element disposed in said valve body cavity for controlling the flow of the first and second fluids through said valve body cavity;

a valve stem for actuating said first and second valve elements;

a vertical depression of said valve stem opening only said first valve element for enabling the first fluid to be introduced under pressure into said first inner container; and a tilting of said valve stem simultaneously opening said first and second valve elements enabling the simultaneous mixing and dispensing of the first and second fluids from the terminal orifice.

7. An improved aerosol dispenser for mixing and dispensing a first and a second fluid product from an aerosol container having an annular bead defining an opening in the aerosol container, comprising:

a mounting cup having a peripheral rim for sealing with the annular bead of the aerosol container;

said mounting cup having a turret;

a valve sealing gasket having central aperture extending between opposed sides of said valve sealing gasket;

an aerosol valve body extending between a first and a second valve body end with a valve body cavity defined in said first valve body end;

said aerosol valve body being secured to said mounting cup with one of said sides of said valve sealing gasket engaging with said first valve body end and with the other of said sides of said valve sealing gasket engaging with said turret for sealing said aerosol valve body to the mounting cup;

a first channel defined in said valve body in proximity to said second valve body end for providing fluid communication with said valve body cavity;

a second channel defined in said valve body remote from said second valve body end for providing fluid communication with said valve body cavity;

a first flexible inner container secured to said second end of said valve body for communicating only with said first channel;

a second flexible inner container engaging with said annular bead of the aerosol container thereby defining a second inner container opening;

said valve stem slidably extending through said central aperture of said valve sealing gasket with said enlarged flange being located with within said valve body cavity adjacent to said side of said valve sealing gasket engaging with said first valve body end for enabling a vertical depression of said valve stem;

said first end of said valve stem defining an enlarged flange extending radially outwardly from said outer surface of said valve stem;

said valve stem extending through said central aperture of said valve sealing gasket with said enlarged flange being located with said valve body cavity;

an actuator having a terminal orifice secured to said second end of said valve stem;

said valve stem actuating a first and a second valve element disposed in said valve body cavity for controlling the flow of the first and second fluids through said valve body cavity;

a vertical depression of said valve stem opening only said first valve element for enabling dispensing of only the first fluid from said terminal orifice; and a tilting of said valve stem simultaneously opening said first and second valve elements for enabling the simultaneous mixing and dispensing of the first and second fluids from said terminal orifice.

8. An improved aerosol dispenser for mixing and dispensing a first and a second fluid product from an aerosol container having an annular bead defining an opening in the aerosol container, comprising:

a mounting cup having a peripheral rim for sealing with the annular bead of the aerosol container;

said mounting cup having a turret;

a valve sealing gasket having central aperture extending between opposed sides of said valve sealing gasket;

an aerosol valve body extending between a first and a second valve body end with a valve body cavity defined in said first valve body end;

said aerosol valve body being secured to said mounting cup with one side of said valve sealing gasket engaging with said first valve body end of said aerosol valve body and with the other side of said valve sealing gasket engaging with said turret for sealing said aerosol valve body to the mounting cup;

a first channel defined in said valve body in proximity to said second valve body end for providing fluid communication with said valve body cavity;

a second channel defined in said valve body remote from said second valve body end for providing fluid communication with said valve body cavity;

a first flexible inner container secured to said second end of said valve body for communicating only with said first channel;

a second flexible inner container engaging with said annular bead of the aerosol container thereby defining a second inner container opening;

a valve stem extending between a first and a second end and having an outer surface with a stem passageway extending between said first and second ends of said valve stem;

said first end of said valve stem defining an enlarged flange extending radially outwardly from said outer surface of said valve stem;

said valve stem slidably extending through said central aperture of said valve sealing gasket with said enlarged flange being located within said valve body cavity adjacent to said side of said valve sealing gasket engaging with said first valve body end for enabling a vertical depression of said valve stem;

an actuator having a terminal orifice secured to said second end of said valve stem;

a valve element base extending between a first and a second end;

said first end of the valve element base including a recess defining an annular projection;

said recess adapted for receiving said annular flange of said valve stem;

said annular projection forming a first valve element for sealing with said valve sealing gasket;

said second end of the valve element base defining a cylindrical bore;

a movable member extending between a first and a second end slidably received within said cylindrical bore of said valve element base;

a biasing spring interposed between said valve element base and said first end of movable member;

said second end of said movable member forming a second valve element;

said bias spring biasing said first and second valve elements to a closed position to inhibit the flow of the first and second fluid products through the first and second channels;

said bias spring biasing said first valve element of the annular projection into sealing engagement with the valve sealing gasket to inhibit the flow of the first fluid product;

said bias spring biasing said second valve element into sealing engagement with the said second channel to inhibit the flow of the second fluid product;

said valve stem actuating a first and a second valve element disposed in said valve body cavity for controlling the flow of the first and second fluids through said valve body cavity;

a vertical depression of said valve stem opening only said first valve element for enabling dispensing of only the first fluid from said terminal orifice; and a tilting of said valve stem simultaneously opening said first and second valve elements for enabling the simultaneous mixing and dispensing of the first and second fluids from said terminal orifice.

* * * * *